US007168277B2

(12) United States Patent
Thomae et al.

(10) Patent No.: US 7,168,277 B2
(45) Date of Patent: Jan. 30, 2007

(54) PRESS WITH A DEVICE FOR DETECTING A MUTUAL REFERENCE POSITION OF TOOL PARTS OF A PRESSING TOOL

(75) Inventors: Martin Thomae, Bietigheim-Bissingen (DE); Peter Bytow, Simmozheim (DE)

(73) Assignee: Trumpf Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 11/197,770

(22) Filed: Aug. 5, 2005

(65) Prior Publication Data

US 2006/0032283 A1 Feb. 16, 2006

(30) Foreign Application Priority Data

Aug. 9, 2004 (EP) ..... 04018859

(51) Int. Cl.
*B21C 51/00* (2006.01)

(52) U.S. Cl. ..... 72/21.4; 100/50

(58) Field of Classification Search ..... 72/17.2, 72/21.4, 21.5; 73/1.79; 100/43, 49, 50
See application file for complete search history.

(56) References Cited

U.S. PATENT DOCUMENTS 3,587,360 A * 6/1971 Oxenham ..... 483/10
5,031,431 A * 7/1991 Naito ..... 72/21.5
2005/0271485 A1* 12/2005 Kouno et al. ..... 408/124

FOREIGN PATENT DOCUMENTS

| | | |
|---|---|---|
| DE | 1 903 564 | 11/1969 |
| DE | 0 284 903 | 10/1988 |
| EP | 1 123 169 B1 | 6/2003 |
| JP | 2-235599 | 9/1990 |
| JP | 2001-198622 | 7/2001 |
| WO | 2004/037482 | 5/2004 |

OTHER PUBLICATIONS

Heckel, "Optische 3D-Kontuerfassung und on-line Biegewinkelmessung mit dem Lichtschnittverfahren", Carl Hansen Verlag , Munich Wien, Jan. 30, 1995.
Partial translation of AQ.

* cited by examiner

*Primary Examiner*—Lowell A. Larson
*Assistant Examiner*—Debra Wolfe
(74) *Attorney, Agent, or Firm*—Fish & Richardson P.C.

(57) ABSTRACT

Devices are provided for detecting a mutual reference position of tool parts of a pressing tool, e.g., a punch and die. The device include (a) first and second reference elements that are moveable, by the pressing device, into a relative position that corresponds to a predetermined relative position of the first tool part and the second tool part as mounted in the mountings; (b) a control pressure generator that generates a control pressure when the first and second reference elements are moved into the relative position; (c) a switch that is activated by the control pressure; and (d) a detection unit that is activated by activation of the switch to detect the relative position of the first and second reference elements.

18 Claims, 3 Drawing Sheets

PRESS WITH A DEVICE FOR DETECTING A MUTUAL REFERENCE POSITION OF TOOL PARTS OF A PRESSING TOOL

CLAIM OF PRIORITY

This application claims priority under 35 U.S.C. § 119 to European Patent Application Serial No. 04 018 859.1, filed on Aug. 9, 2004, the entire contents of which is hereby incorporated by reference.

TECHNICAL FIELD

The disclosure relates to a press for machining workpieces, in particular to a press with a device for detecting a mutual reference position of tool parts of a pressing tool.

BACKGROUND

On previously known presses (e.g., as disclosed in European Patent Application, EP 1 123 169 B1), a punch and a die of a pressing tool are moved against each other in a stroke direction until the punch meets the die or a plate arranged between the punch and the die. The resulting relative position of the die and punch forms a reference position from which the length of the die is determined. To this end, with the punch sitting on the die or on the plate supported by the die, the position of the punch end remote from the die must be detected.

This can be achieved by means of a detection unit that is activated as soon as the punch comes into contact with the die or the plate. The detection process is triggered by the rise in power consumption of the press drive connected with the action of the punch upon the die or plate. Accordingly, the control of a switching device for the detection unit is integrated in the press drive. The punch and die serve simultaneously as reference elements to detect their mutual reference position. If the position of the punch end that remote from the die is determined, then the punch length is calculated from this position and from the known position of the die surface impacted by the punch and, where applicable, from the known thickness of the plate between the die and the punch.

It would be advantageous to constructionally decouple the control of a detection unit to detect a mutual reference position of the tool parts from the functional machine components necessary for the regular machine operation.

SUMMARY

As disclosed herein the function control of the tool parts of a press can be decoupled at least with substantial parts from the machine drive for regular machine operation of the press. This results in particular in the possibility of supplementing the functionality of existing presses with the function "reference position detection" at relatively low cost.

In a first general aspect, a press adapted for machining a workpiece, in particular for embossing and/or punching metal plates, includes a pressing tool that includes a first tool part mounted in a first tool mounting and a second tool part mounted in a second tool mounting. The first part and the second part are located so as to be on opposing sides of the workpiece during machining of the workpiece. The press further includes a pressing drive adapted to move the first part and the second part toward and away from each other in a stroke direction during machining of the workpiece and first and second reference elements, where the reference elements are moveable into a relative position that corresponds to a predetermined relative position of the first tool part and the second tool part as mounted in the mountings. The press further includes a control pulse emitter that generates a control pulse when the first and second reference elements are moved into the relative position, where at least part of the control pulse emitter is mounted on one of the reference elements or on one of the mountings, such that the control pulse emitter generates the control pulse automatically when the first and second mountings move into the relative position. The press further includes a switch that is activated by the control pulse and a detection unit that is activated by activation of the switch to detect the relative position of the first and second reference elements.

Implementations can include one or more of the following features. For example, the switch can be activated by pressure, and the control pulse emitter can provide a control pressure that is tapped to activate the switch. The control pressure emitter can include a pressure volume, and a pressure of the pressure volume can be tapped as the control pressure to activate the switch, and the pressure of the pressure volume can be set to the control pressure to activate the switch when the first and second reference elements are moved into the relative position. The control pressure emitter can include a pressure volume of a flowable pressure medium that is connected to a source of flowable pressure medium, and under movement of the reference elements into the relative position, an outlet opening of the pressure volume can closed or reduced in area such that the pressure of the pressure volume is increased from an initial pressure to the control pressure or opened or increased in area such that the pressure of the pressure volume is reduced from an initial pressure to the control pressure.

At least one of the reference elements can include two element parts that are movable relative to each other, and, under movement of the reference elements into the relative position, the two element parts can be moved relative to each other to generate the control pulse. The control pressure emitter can include a pressure volume of a flowable pressure medium that is connected to a source of flowable pressure medium, and at least one of the reference elements can include two element parts which, under movement of the reference elements into the relative position, can be moved relative to each other to generate the control pulse, and that cause an outlet opening of the pressure volume to be altered.

The reference element parts together can form a pilot valve, and the pilot value can be a piston valve. At least one of the reference elements can be mounted on at least one of the tool mountings. At least one reference element can include a tool mounting having a connection to a source of flowable pressure medium. The connection to a source of flowable pressure medium can form part of a tool detection device within the tool mounting. The control pulse emitter can be provided at least partly on a reference element, and the outlet opening of the pressure volume can be provided on a reference element. The pilot valve can be provided on a reference element.

The detection unit can form a part of a device that controls a stroke position of the first and second tool parts. The detection unit can form a part of a device that determines a thickness of the workpiece.

In another general aspect, a reference element for detecting a mutual reference position of tool parts of a pressing tool of a press for machining workpieces includes at least a part of a pulse emitter on which a control pulse can be tapped to activate a switch device by means of which a detection unit can be activated to detect a relative position of the reference element and a further reference element, where the reference position is defined in relation a relative position of the tool parts.

The control pulse emitter can be arranged in an area of the press such that it is easily accessible, for example, for maintenance and service or repair.

The control pulse emitter provided in the case of the invention can be of various types.

The details of one or more implementations are set forth in the accompanying drawings and the description below. Other features will be apparent from the description and drawings, and from the claims.

DESCRIPTION OF DRAWINGS

Like reference symbols in the various drawings indicate like elements.

DETAILED DESCRIPTION

Figure 2:
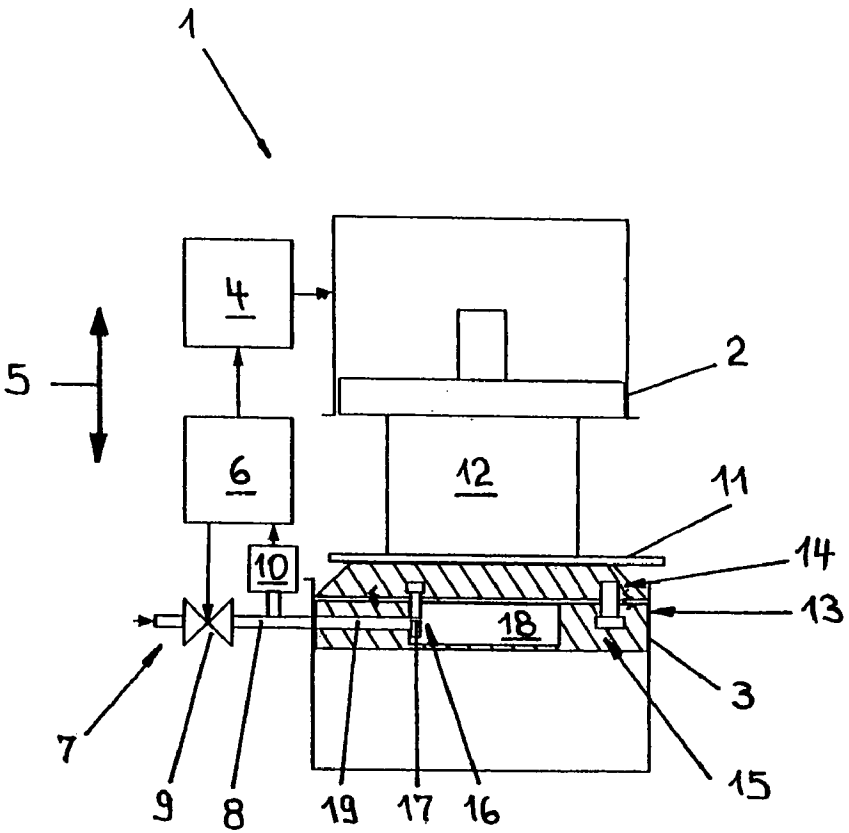
FIGS. 1 and 2 the structure and function in principle of a press with a first design of the device to detect a mutual reference position of the tool parts of a pressing tool, FIGS. 3 and 4 detailed views of a reference element of the device shown highly diagrammatically in FIGS. 1 and 2 for reference position detection, and FIG. 5 the structure and function in principle of a press with a second design of a device to detect a mutual reference position of the tool parts of a pressing tool.
Figure 1:
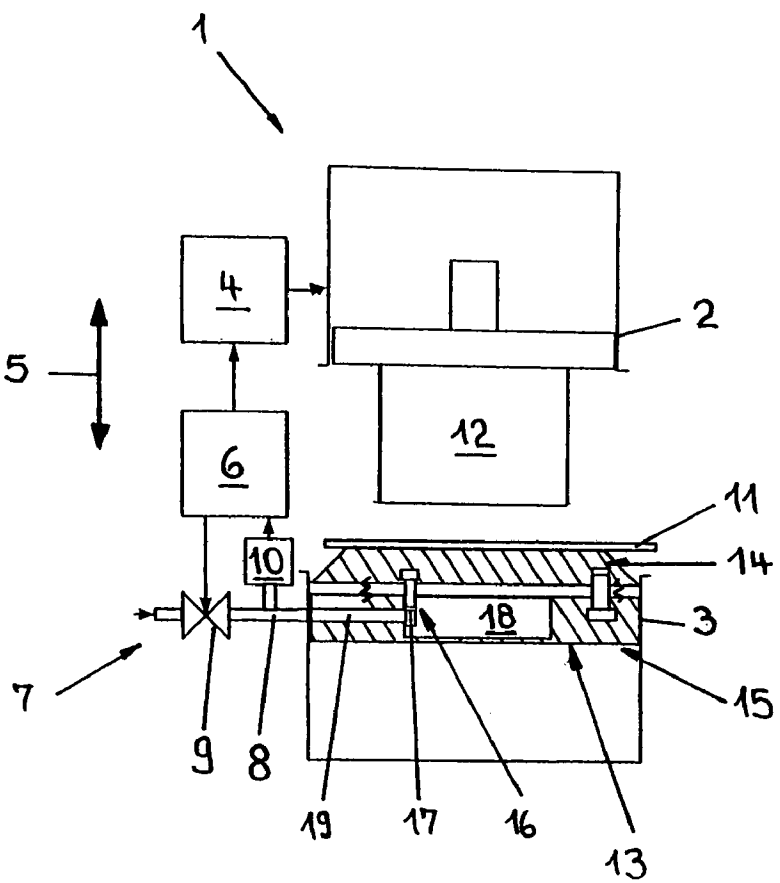

As shown in FIGS. 1 and 2, a press 1 for emboss machining of workpieces includes a punch holder 2 as a tool mounting for a machining punch and a die holder 3 as a tool mounting for a machining die. Corresponding conditions exist on presses for other applications, for example, on presses for punch machining, forming, and/or surface treatment of workpieces.

The die holder 3 can be integrated stationarily in a machine table (not shown). The punch holder 2 can be provided on a ram (also not shown) that is mobile by means of a motorized press drive 4 in a stroke direction 5 that is illustrated by the double arrow in FIG. 1. The press drive 4 of the press 1 is controlled by means of a numerical machine control 6 through which the stroke end positions of the ram of the press 1 are adjustable in the stroke direction 5.

During regular operation, i.e., during workpiece machining, a machining punch of normal design is inserted in the punch holder 2, and a conventional machining die is inserted in the die holder 3. A compressed air supply 7 of the press 1 can be opened to a compressed air line 8 in the wall of the die holder 3.

Before use of the press drive 4, the compressed air line 8 exsposed to compressed air by corresponding control of compressed air valve 9 by means of the machine control 6. When a machining die is inserted in the die holder 3, this closes the opening of the compressed air line 8 at the wall of the die holder 3, such that positive pressure then builds up in the compressed air line. However, this pressure build up does not occur if a machining die is not inserted in the die holder 3. In each case the pressure in the compressed air line 8 is tapped by a manometer 10. Only when a positive pressure is established in the compressed air line 8 does the manometer 10 generate a signal for the machine control 6, which sets the press drive 4 in motion. Consequently, the compressed air line 8 forms part of a device for tool detection used in workpiece machining.

The press 1 can be used to machine workpieces in the form of plates 11. By means of the press drive 4 of the press 1, the machining punch mounted in the punch holder 2 of the ram is moved to and fro in the stroke direction 5 between an upper and a lower stroke end position. The upper and, particularly also, the lower stroke end position of the machining punch are set such that the machining punch penetrates sufficiently deep into the plate 11 and gives a good machining result.

For various reasons during continuous operation of the press 1 an undesirable shift of the stroke end position of the machining punch can occur. A possible cause for such stroke position shift is the operational heating of the normally hydraulic press drive 4. External temperature influences are also possible reasons for a stroke position shift.

An undesirable shift of the lower stroke end position can cause the machining punch to either not penetrate far enough into the plate 11 to be machined or to penetrate too far into the plate 11, an incorrect immersion depth of the machining punch can lead to a reduction in quality of the machining result. Fluctuations in the thickness of the plate 11 to be machined can have a similar effect. For example, if the thickness of a plate 11 is unpredictably less than assumed, this can lead to the machining punch, at a given stroke end position setting, not being pressed with sufficient penetration depth into the plate 11 in the lower stroke end position.

To avoid an impairment in the machining result, on the press 1 particularly the lower stroke end position of the machining die is checked from time to time and if necessary reset. To achieve this, first a mutual reference position of the machining punch and the machining die in the stroke direction 5 is detected. To this end, at the punch holder 2, the machining punch is exchanged for an upper reference element 12 and at the die holder 3, the machining die is exchanged for a lower reference element 13. This exchange is performed automatically like a conventional tool change. After the exchange, the punch holder 2 and the die holder 3 then form reference element mountings. For provisional fixing in the punch holder 2 and in the die holder 3, the reference elements 12 and 13 have mounting devices that correspond to those of the machining punch and the machining die.

Then the plate 11 to be machined is moved by means of a conventional co-ordinate guide into the space between the upper reference element 12 and the lower reference element 13 where it comes to lie on a workpiece support 14 of the lower reference element 13. This gives the conditions shown in FIG. 1.

In the stroke direction 5, the workpiece support 14 is spaced relatively far from a base part 15 of the lower reference element 13. In the stroke direction 5, the workpiece support 14 is guided mobile on the base part 15. A pilot valve 16 with an air passage 17 is attached to the workpiece support 14 and protrudes into a chamber 18 on the base part 15. Thus, the pilot valve 16 closes a compressed air line 19 of the base part 15 on the side of the chamber 18. Opposite the chamber 18, the compressed air line 19 of the base part 15 opens into the compressed air line 8 on the die holder 3.

Starting from this operating state, the compressed air valve 9 is opened by a corresponding command via the machine control 6. Consequently, the compressed air line 8 at the die holder 3 and the compressed air line 19 at the base part 15 of the lower reference element 13 are supplied with compressed air from the compressed air supply 7 of the press 1. After the compressed air line 19 is closed by the pilot valve 16 at its end lying towards the chamber 18 of the base part 15 a positive pressure builds up, in the inside of the compressed air lines 8 and 19, which finally reaches the value of the positive pressure in the compressed air line 8 at the machining die 3 present in the die holder 3. The pressure volume contained in the compressed air lines 8 and 19 forms a pressure emitter for the manometer 10 by which the internal pressure in the compressed air lines 8 and 19 is tapped. If the pressure inside the compressed air lines 8 and 19 corresponds to the pressure in the compressed air line 8 when the press 1 is ready for function, the manometer 10 generates a signal for the numerical machine control 6 via which the press drive 4 of the press 1 is consequently set in motion. By means of the press drive 4, the die holder 2 with the upper reference element 12 is lowered in the stroke direction 5. The upper reference element 12 runs onto the plate 11 and presses this together with the workpiece support 14 of the lower reference element 13 in the direction of the base part 15 of the lower reference element 13. This is associated with a corresponding displacement of the pilot valve 16 on the workpiece support 14. The pilot valve 16 with the air passage 17 reaches the opening of the compressed air line 19 lying towards the chamber 18 of the lower reference element 13 which gives the conditions shown in FIG. 2. Compressed air in the compressed air lines 8 and 19 can now escape via the air passage 17 of the pilot valve 16 into the chamber 18 of the lower reference element 13, and from there through a gap remaining between the workpiece support 14 and the base part 15 of the lower reference element 13, and, as a result, the internal pressure in the compressed air lines 8 and 19 falls. The reduced pressure is also detected by means of the manometer 10.

The workpiece support 14 together with the pilot valve 16 is lowered in the stroke direction 5 until the workpiece support 14 sits on the base part 15 of the lower reference element 13. In this position of the workpiece support 14 in the stroke direction 5, the air passage 17 of the pilot valve 16 lies as before at the height of the opening of the compressed air line 19. Up to this operating state, the lowering movement of the ram of the press 1 to shift the workpiece support 14 of the lower reference element 13 down in the stroke direction 5 was performed with relatively large speed. As a result of the action upon the base part 15 the lower reference element 13 is pressed as a whole against the base of the die holder 3. This eliminates any incorrect positioning of the lower reference element 13.

The reaching of the lowering end position of the ram on contact of the workpiece support 14 on the base part 15 of the lower reference element 13 is detected by the machine control 6 from the increasing power consumption of the stroke drive 4. The machine control 6 then initiates a slow return stoke of the ram of the press 1 in the upward stroke direction 5. This return stroke movement of the ram is accompanied by a relief of the workpiece support 14 from the pressure exerted by the upper reference element 12. Under the effect of a return spring, pretensioned on the previous downward movement, between the base part 15 and the workpiece support 14, the workpiece support 14 with the plate 11 now performs a return stroke movement in the upward stroke direction 5. The workpiece support 14 is supported over the plate 11 on the upper reference element 12. Connected with the return stroke movement of the workpiece support 14 is a corresponding movement of the pilot valve 16. The pilot valve 16 leaves with the air passage 17 the area of the opening of the compressed air line 19 and again reaches its position according to FIG. 1 in which it closes the compressed air line 19 at the side facing towards the chamber 18. Connected with closure of the compressed air line 19 is a pressure rise in the compressed air lines 8 and 19.

As soon as the pressure rise begins and is tapped by the manometer 10 at the compressed air lines 8 and 19, the manometer 10 generates a signal for the machine control 6 which firstly shuts down the pressure drive 4 and secondly causes the position of the upper reference element 12 in the stroke direction 5 to be detected. To this end, the signal generated by the manometer 10 under pressure control causes the activation of a switch device integrated in the machine control 6 for a distance measurement system of the machine control 6 serving as a detection unit. The detection unit or distance measurement system is thus activated and detects the position of the upper reference element 12. In the detection position shown in FIG. 1, the upper reference element 12, with the workpiece support 14 lying thereon via the plate 11 of the lower reference element 13, was moved from the previous maximum lowered position with relatively low speed. Consequently, a prompt and precise detection is ensured of the start of the pressure rise upon the transition of the pilot valve 16 from a position allowing the emergence of compressed air from the compressed air line 19 into a position blocking the emergence of compressed air.

At the same time, i.e., at the start of the pressure rise in the compressed air lines 8 and 19, the lower reference element 13 lies with the top of the workpiece support 14 in the stroke direction 5 at a level that represents the level of the top of the machining die in workpiece machining. In the example shown in FIG. 1, the level of the top of the workpiece support 14 at the lower reference element 13 corresponds to the level of the top of the machining die.

Once this position is known, it is stored in the numerical machine control 6, and from the known position of the lower reference element 13 or the workpiece support 14 and from the result of the detection initiated by the manometer 10 of the position of the upper reference element 12, the numerical machine control 6 can calculate the thickness of the plate 11.

The position assumed by the upper reference element 12 on direct pressurization of the workpiece support 14 of the lower reference element 13, being in the position according to FIG. 1, stands in a defined connection with the lower stroke target end position into which the machining punch on workpiece machining should be moved in the stroke direction 5 in order to achieve a high quality machining result. The upper reference element 12 according to FIG. 1 is separated from this position by the previously determined thickness of the plate 11. Using this determined plate thickness, the position of the upper reference element 12 can be determined, which can then be allocated to the lower stroke target end position of the machining punch. From the position of the upper reference element 12 determined in this way, finally the lower stroke target end position of the machining punch can be derived. The stroke target end position arising from the detected position of the upper reference element 12 for the machining punch is compared in the machine control 6 with the stroke end position actually set that is stored there. On deviation of the target from the actual position, the machine control 6 corrects the stroke end position setting to eliminate the positional deviation.

A corresponding stroke end position control or correction can be performed by means of the reference elements 12 and 13 even without inclusion of the plate 11. In this case the upper reference element 12 sits directly on the workpiece support 14 of the lower reference element 13. Here too the time of position detection is marked by the start of the pressure rise in the compressed air lines 8 and 19 on slow return of the tool support 14 from the maximum lowered position.

Finally, the upper reference element 12 and the lower reference element 13 are replaced by the respective machining punch and machining die. The plate 11 is then machined with the previously optimized stroke end position setting of the machining die.

Figure 3:
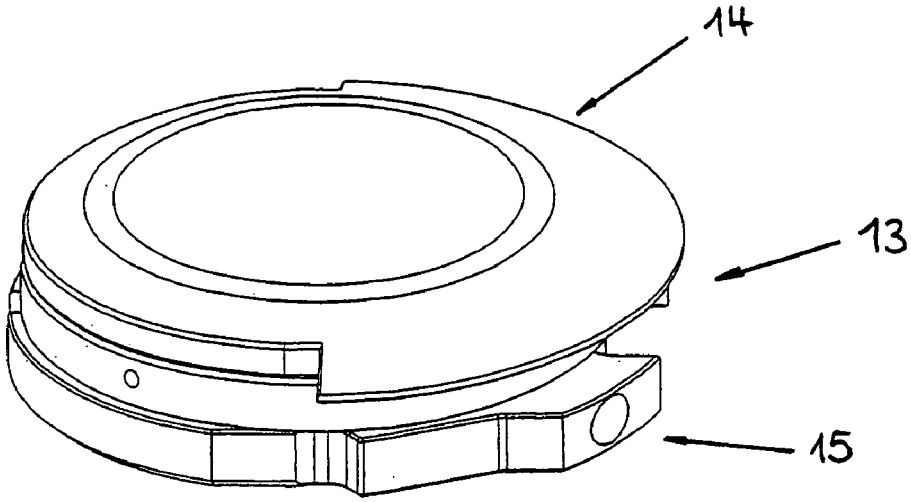
Figure 4:
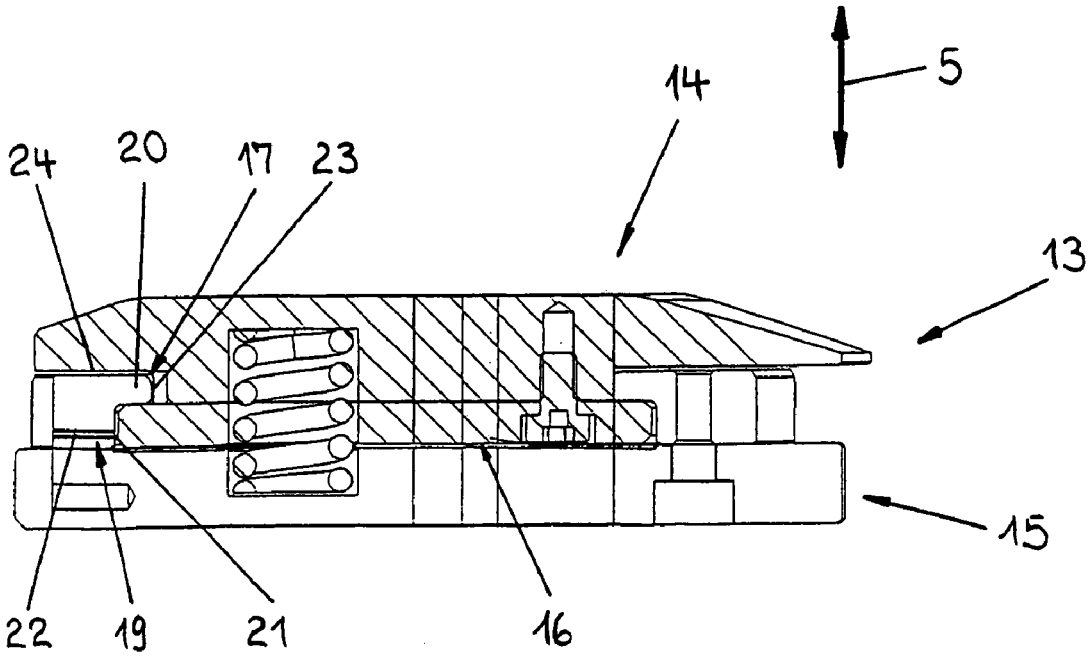

FIGS. 3 and 4 show in detail the lower reference element 13 previously described. The base part 15 of the lower reference element 13 is shown pot-like and with an inwardly protruding pot edge 20 that extends over the pilot valve 16. The pilot valve 16 forms a piston valve that is bolted to the tool support 14 of the lower reference element 13. The diameter of the piston valve or pilot valve 16 is less than the diameter of the undercut holding it and limited by the pot edge 20 on the base part 15 of the lower reference element 13. Consequently, between the pilot valve 16 and the base part 15 is formed an annular chamber 21, which, together with a line section 22 passing through the base part 15, forms the compressed air line 19 previously described.

As shown in FIGS. 3 and 4, the lower reference element 13 is in the functional state according to FIG. 1. The piston valve or pilot valve 16, under the effect of a return spring supported at one side on the base part 15 and on the other side on the workpiece support 14 of the lower reference element 13, is pressed on the underside of the inwardly protruding pot edge 20. Due to the tight seal between the pot edge 20 and the pilot valve 16, compressed air is prevented from flowing out from the compressed air line 19.

If the workpiece support 14 of the lower reference element 13 is lowered starting from this operating state under pressurization by the upper reference element 12, between the top of the pilot valve 16 and the underside of the inwardly protruding pot edge 20 is formed a space through which compressed air can escape from the inside of the compressed air line 19. The compressed air takes a path via the resulting free space between the pot edge 20 and the closing valve 16, an annular chamber 23 between the pot edge 20 and the workpiece support 14, and a space 24 between the top of the pot edge 20 and the underside of the edge of the workpiece support 14. In comparison with the conditions shown in FIG. 4, the space 24 is reduced in height when the workpiece support 14 is lowered. Together with the annular chamber 23 and the free space between the underside of the pot edge 20 and the top of the pilot valve 16 when the workpiece support 14 is lowered, the space 24 between the top of the pot edge 20 and the underside of the edge of the workpiece support 14 forms the air passage 17 according to FIGS. 1 and 2.

Figure 5:
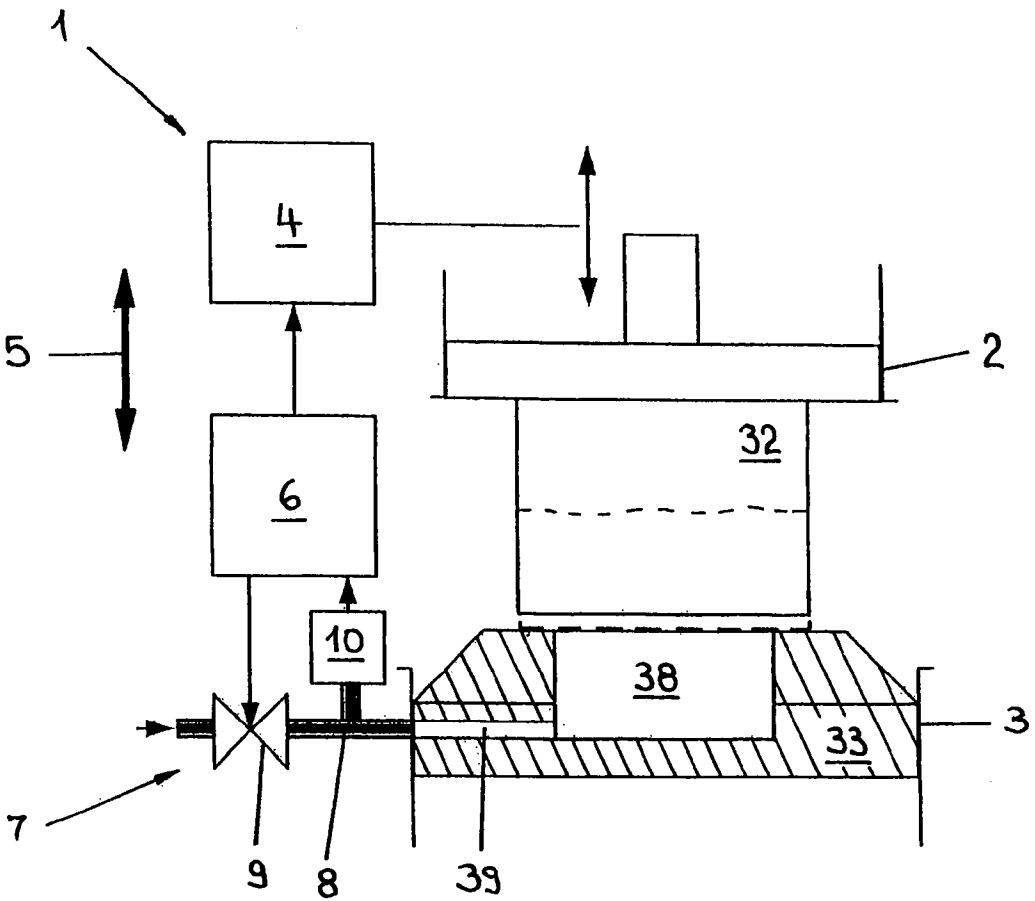

As is evident from FIG. 5 in comparison with the conditions in FIGS. 1 and 2, a lower reference element 33 is inserted in the die holder 3 on the press 1. This is formed as one piece and fitted with a chamber 38 and a compressed air line 39. The compressed air line 39 is connected to the compressed air line 8 of the die holder 3. An upper reference element 32 allocated to the lower reference element 33 corresponds in structure to the upper reference element 12 according to FIGS. 1 and 2.

In the case of the arrangement according to FIG. 5, detection of the relative position of the upper reference element 32 and lower reference element 33 in the stroke direction 5 is triggered as soon as the upper reference element 32 meets the lower reference element 33. This closes the chamber 38 in the inside of the lower reference element 33 and under the effect of the compressed air from the compressed air supply 7 a positive pressure builds up inside the chamber 38 and in the compressed air lines 8 and 39. The pressure volume inside the chamber 38 and the compressed air lines 8 and 39 forms a control pressure emitter for the manometer 10. This taps the positive pressure and, according to the function principle described above in FIGS. 1 and 2, causes detection of the relative position of the upper reference element 32 and the lower reference element 33, and via this relative position detection, causes detection of a mutual reference position of the machining punch and machining die in the press 1 in the stroke direction 5. The lower stroke target end position of the machining punch determined by detection of the mutual reference position is compared with the stroke end position set and the position setting corrected where necessary.

A number of implementations have been described. Nevertheless, it will be understood that various modifications may be made. Accordingly, other embodiments are within the scope of the following claims.

What is claimed is:

1. A press adapted for machining a workpiece, in particular for embossing and/or punching metal plates, the press comprising:

a pressing tool comprising a first tool part mounted in a first tool mounting and a second tool part mounted in a second tool mounting, the first part and the second part located so as to be on opposing sides of the workpiece during machining of the workpiece;

a pressing drive adapted to move the first part and the second part toward and away from each other in a stroke direction during machining of the workpiece;

first and second reference elements, wherein the reference elements are moveable, by the pressing device, into a relative position that corresponds to a predetermined relative position of the first tool part and the second tool part as mounted in the mountings;

a control pulse generator that generates a control pulse when the first and second reference elements are moved into the relative position, wherein at least part of the control pulse generator is mounted on one of the reference elements, that is provided instead of one of the tool parts and the relative position of which is to be detected, or on one of the mountings, such that the control pulse generator generates the control pulse automatically when the first and second mountings move into the relative position;

a switch that is activated by the control pulse; and a detection unit that is activated by activation of the switch to detect the relative position of the first and second reference elements.

2. The press of claim 1, wherein the switch is activated by pressure, and wherein the control pulse generator comprises a control pressure generator that provides a control pressure that is tapped to activate the switch.

3. The press of claim 2, wherein the control pressure generator defines a volume, and wherein a pressure within the volume is tapped as the control pressure to activate the switch, and wherein the pressure within the volume is set to the control pressure to activate the switch when the first and second reference elements are moved into the relative position.

4. The press of claim 2, wherein the pressure within the volume is generated by a flowable pressure medium delivered to the control pressure generator from a source of flowable pressure medium, and wherein under movement of the reference elements into the relative position, an outlet opening of the volume is closed or reduced in area such that the pressure within the volume is increased from an initial pressure to the control pressure.

5. The press of claim 2, wherein the pressure with in volume is generated by a flowable pressure medium delivered to the control pressure generator from a source of flowable pressure medium, and wherein under movement of the reference elements into the relative position, an outlet opening of the volume is opened or increased in area such that the pressure within volume is reduced from an initial pressure to the control pressure.

6. The press of claim 1, wherein at least one of the reference elements comprises two element parts movable relative to each other, and wherein, under movement of the reference elements into the relative position, the two element parts are moved relative to each other to generate the control pulse.

7. The press of claim 2, wherein the pressure with in volume is generated by a flowable pressure medium delivered to the control pressure generator from a source of flowable pressure medium, and wherein at least one of the reference elements comprises two element parts which, under movement of the reference elements into the relative position, are moved relative to each other to generate the control pulse, and that cause an outlet opening of the volume to be altered.

8. The press of claim 7, wherein the reference element parts together comprise a pilot valve.

9. The press of claim 8, wherein the pilot value is a piston valve.

10. The press of claim 1, wherein at least one of the reference elements is mounted on at least one of the tool mountings.

11. The press of claim 1, wherein as at least one reference element comprises a tool mounting having a connection to a source of flowable pressure medium.

12. The press of claim 11, wherein the connection to a source of flowable pressure medium forms part of a tool detection device within the tool mounting.

13. The press of claim 1, wherein the control pulse generator is provided at least partly on a reference element.

14. The press of claim 4, wherein the outlet opening of the volume is provided on a reference element.

15. The press of claim 7, wherein the pilot valve is provided on a reference element.

16. The press of claim 1, wherein the detection unit forms a part of a device that controls a stroke position of the first and second tool parts.

17. The press of claim 1, wherein the detection unit forms a part of a device that determines a thickness of the workpiece.

18. A reference element for detecting a mutual reference position of tool parts of a pressing tool of a press for machining workpieces, the reference element being provided instead of one of the tool parts, the relative position of which is to be detected, and the reference element comprising:

at least a part of a pulse generator on which a control pulse can be tapped to activate a switch device by means of which a detection unit can be activated to detect a relative position of the reference element and a further reference element, wherein the reference position is defined in relation a relative position of the tool parts.

* * * * *